US007899386B2

(12) United States Patent
Saeki et al.

(10) Patent No.: US 7,899,386 B2
(45) Date of Patent: Mar. 1, 2011

(54) IMAGE FORMING APPARATUS AND GUIDE THEREFOR CAPABLE OF REDUCING TONER SCATTERED ON RECORDING MEDIUM

(75) Inventors: Kazuchika Saeki, Atsugi (JP); Mitsuru Takahashi, Kawasaki (JP); Kazuosa Kuma, Yokohama (JP); Takeshi Fukao, Yokohama (JP); Tsutomu Katoh, Kawasaki (JP); Yoshiharu Kishi, Yokohama (JP)

(73) Assignee: Ricoh Co., Ltd., Tokyo (JP)

( * ) Notice: Subject to any disclaimer, the term of this patent is extended or adjusted under 35 U.S.C. 154(b) by 350 days.

(21) Appl. No.: 11/588,340

(22) Filed: Oct. 27, 2006

(65) Prior Publication Data

US 2007/0098472 A1 May 3, 2007

(30) Foreign Application Priority Data

Oct. 31, 2005 (JP) ..... 2005-317788

(51) Int. Cl.
*G03G 15/00* (2006.01)

(52) U.S. Cl. ..... 399/400; 399/397

(58) Field of Classification Search ..... 399/397, 399/400

See application file for complete search history.

(56) References Cited

U.S. PATENT DOCUMENTS

| | | | | |
|---|---|---|---|---|
| 5,926,683 | A * | 7/1999 | Yuminamochi et al. | 399/398 |
| 5,950,062 | A | 9/1999 | Yahata et al. | |
| 5,983,060 | A | 11/1999 | Namekata et al. | |
| 6,006,062 | A | 12/1999 | Takahashi et al. | |
| 6,101,361 | A * | 8/2000 | Karashima et al. | 399/316 |
| 6,223,008 | B1 | 4/2001 | Takahashi et al. | |
| 6,336,025 | B1 | 1/2002 | Saeki | |
| 6,445,900 | B2 | 9/2002 | Fukao et al. | |
| RE38,206 | E | 7/2003 | Bisaiji et al. | |
| 6,611,672 | B2 | 8/2003 | Aoki et al. | |
| 6,690,905 | B2 | 2/2004 | Takahashi et al. | |
| 6,697,595 | B2 | 2/2004 | Kawagoe et al. | |
| 6,741,821 | B2 | 5/2004 | Sugino et al. | |
| 6,785,500 | B2 | 8/2004 | Takahashi et al. | |
| 6,868,248 | B2 | 3/2005 | Fukao et al. | |
| 6,901,234 | B2 | 5/2005 | Ogiyama et al. | |
| 7,509,073 | B2 * | 3/2009 | Katoh et al. | 399/121 |

(Continued)

FOREIGN PATENT DOCUMENTS

JP 59-71070 4/1984

(Continued)

OTHER PUBLICATIONS

U.S. Appl. No. 11/934,981, filed Nov. 5, 2007, Furuya et al.

(Continued)

*Primary Examiner* — Daniel J Colilla
*Assistant Examiner* — Allister Primo
(74) *Attorney, Agent, or Firm* — Oblon, Spivak, McClelland, Maier & Neustadt, L.L.P.

(57) ABSTRACT

An image forming apparatus includes an image carrier, a transferor, a fixing unit, and a guide. The image carrier carries a toner image. The transferor opposes the image carrier to form a transfer nip and transfers the toner image on the image carrier onto a recording medium at the transfer nip. The fixing unit fixes the toner image on the recording medium. The guide guides the recording medium bearing the toner image from the transferor toward the fixing unit and includes a surface portion directly contacting the recording medium. The surface portion includes a material for charging the recording medium to have a polarity opposite to the polarity of a toner forming the toner image.

18 Claims, 6 Drawing Sheets

U.S. PATENT DOCUMENTS

| | | | | |
|---|---|---|---|---|
| 2002/0009314 | A1* | 1/2002 | Nakayama | 399/297 |
| 2003/0118359 | A1 | 6/2003 | Ogiyama et al. | |
| 2005/0047816 | A1 | 3/2005 | Uchida et al. | |
| 2005/0084305 | A1* | 4/2005 | Nishida et al. | 399/346 |
| 2005/0163546 | A1* | 7/2005 | Kim | 399/367 |
| 2006/0127116 | A1 | 2/2006 | Ogiyama et al. | |
| 2006/0056884 | A1 | 3/2006 | Sawai et al. | |
| 2006/0072929 | A1 | 4/2006 | Takahashi | |
| 2006/0083560 | A1* | 4/2006 | Fukuda | 399/327 |

FOREIGN PATENT DOCUMENTS

| | | | | |
|---|---|---|---|---|
| JP | 60256175 | A | * | 12/1985 |
| JP | 61-47978 | | | 3/1986 |
| JP | 6-27845 | | | 2/1994 |
| JP | 8-62995 | | | 3/1996 |
| JP | 9-40225 | A | | 2/1997 |
| JP | 2000-259017 | | | 9/2000 |
| JP | 2001072281 | A | * | 3/2001 |
| JP | 2002-196545 | | | 7/2002 |
| JP | 2003-57956 | A | | 2/2003 |
| JP | 2004-12926 | A | | 1/2004 |
| JP | 2005-156905 | | | 6/2005 |

OTHER PUBLICATIONS

U.S. Appl. No. 11/943,941, filed Nov. 21, 2007, Katoh et al.

* cited by examiner

IMAGE FORMING APPARATUS AND GUIDE THEREFOR CAPABLE OF REDUCING TONER SCATTERED ON RECORDING MEDIUM

CROSS-REFERENCE TO RELATED APPLICATION

The present application is based on and claims priority to Japanese patent application No. 2005-317788 filed on Oct. 31, 2005 in the Japan Patent Office, the entire contents of which are hereby incorporated herein by reference.

BACKGROUND OF THE INVENTION

1. Field of the Invention

Exemplary aspects of the present invention relate to an image forming apparatus and a guide therefor, and more particularly to an image forming apparatus and a guide for guiding a recording medium bearing a toner image from a transferor to a fixing unit.

2. Description of the Related Art

A related art image forming apparatus, such as a copying machine, a facsimile machine, a printer, or a multifunction printer having copying, printing, scanning, and facsimile functions, forms an electrostatic latent image on a photoconductor according to image data. The electrostatic latent image is developed with a developer (e.g., a toner) to form a toner image on the photoconductor. The toner image is transferred onto a recording medium (e.g., a sheet of paper) and sent to a fixing unit. In the fixing unit, a fixing roller and a pressing roller apply heat and pressure to the recording medium bearing the toner image to fix the toner image on the recording medium.

The toner image formed on the photoconductor may be transferred onto the recording medium directly from the photoconductor or indirectly via an intermediate transfer medium (hereinafter referred to as the intermediate transfer belt). When the toner image is indirectly transferred via the intermediate transfer belt, the toner image formed on the photoconductor is transferred onto the intermediate transfer belt, and further transferred from the intermediate transfer belt onto the recording medium. The photoconductor or the intermediate transfer belt opposes a transfer bias roller to form a transfer nip at which the toner image is transferred from the photoconductor or the intermediate transfer belt onto one side (i.e., front side) of the recording medium. Specifically, the transfer bias roller applies a transfer bias having a polarity opposite to the polarity of a toner forming the toner image to the other side (i.e., backside) of the recording medium. Thus, the recording medium has an electric charge having the polarity opposite to the polarity of the toner and thereby attracts the toner, resulting in electrostatic transfer of the toner image.

When the amount of electric charge on the backside of the recording medium is too large, the recording medium is electrostatically attracted to the photoconductor or the intermediate transfer belt after the recording medium passes the transfer nip. In this case, a problem occurs such that the recording medium cannot separate from the photoconductor or the intermediate transfer belt, resulting in jamming of the recording medium. In addition, a problem which occurs is that the electric charge is abruptly transferred from the backside of the recording medium to a protruding member and/or a metallic member disposed on a downstream side from the transfer nip and on an upstream side from the fixing unit in a conveyance direction of the recording medium. This problem results in formation of a defective toner image, including small circle marks on the recording medium.

Further, when the backside of the recording medium has too large an amount of electric charge, the front side of the recording medium has a substantial amount of electric charge having a polarity opposite to the polarity of the electric charge of the backside of the recording medium. When the electric charge of the front side of the recording medium moves along the surface thereof, the toner image on the front side of the recording medium may be deformed. Specifically, a defective toner image (such as zigzag images) may be formed along a trail of the moving electric charge.

To address the above-described problems, an example of a related art image forming apparatus is proposed which further includes a discharger for discharging the backside of the recording medium immediately after the recording medium passes the transfer nip.

In addition, a related art image forming apparatus is provided which uses a spherical toner manufactured by a polymerization method so as to form a high resolution toner image. Toner particles of the spherical toner make point-contact with each other. Therefore, the toner particles attract each other with a decreased attracting force and have an increased flowability. The toner particles also make point-contact with the photoconductor or the intermediate transfer belt. Therefore, the photoconductor or the intermediate transfer belt attracts the toner particles with a decreased attracting force, thereby increasing transfer efficiency.

In the fixing unit, the fixing roller opposes the pressing roller to form a fixing nip at which the fixing roller and the pressing roller apply heat and pressure to the recording medium bearing the toner image so as to fix the toner image on the recording medium. When the fixing roller scrubs the pressing roller or the recording medium at the fixing nip, the fixing roller may be charged with the polarity opposite to the polarity of the toner by friction between the fixing roller and the pressing roller or the recording medium. When a recording medium bearing a toner image formed with a spherical toner is conveyed toward the fixing nip in a low temperature and low humidity environment, the toner on the recording medium may scatter in the moving direction of the recording medium immediately before the toner image reaches the fixing nip.

The related art image forming apparatus further includes a guide for guiding the recording medium bearing the toner image from the transfer nip toward the fixing unit. While the guide guides the recording medium, the recording medium scrubs the guide. Friction between the recording medium and the guide may charge the guide with the polarity opposite to the polarity of the toner and may charge the backside of the recording medium with the same polarity as that of the toner. The electric charge having the same polarity as that of the toner of the charged backside of the recording medium counteracts the electric charge having the polarity opposite to the polarity of the toner, i.e., the electric charge applied by the transfer bias roller. Thus, the backside of the recording medium has a decreased amount of electric charge having the polarity opposite to the polarity of the toner. This occurs easily in a low temperature and low humidity environment. The discharger also removes the electric charge from the backside of the recording medium. Thus, the recording medium electrostatically attracts the toner with a decreased attracting force. As a result, the above-mentioned toner scatter problem is caused.

BRIEF SUMMARY OF THE INVENTION

This specification describes below an image forming apparatus according to an exemplary embodiment of the invention. In one aspect of the present invention, the image forming apparatus includes an image carrier, a transferor, a fixing unit, and a guide. The image carrier carries a toner image. The transferor opposes the image carrier to form a transfer nip and transfers the toner image on the image carrier onto a recording medium at the transfer nip. The fixing unit fixes the toner image on the recording medium. The guide guides the recording medium bearing the toner image from the transferor toward the fixing unit and includes a surface portion directly contacting the recording medium. The surface portion includes a material for charging the recording medium to have a polarity opposite to the polarity of a toner forming the toner image.

This specification further describes a guide for guiding a recording medium bearing a toner image from a transferor toward a fixing unit according to an exemplary embodiment of the invention. In one aspect of the present invention, the guide includes a discharger and a surface portion. The discharger discharges the recording medium immediately after the transferor transfers the toner image onto the recording medium. The surface portion directly contacts the recording medium and includes a material for charging the recording medium to have a polarity opposite to the polarity of a toner forming the toner image.

BRIEF DESCRIPTION OF THE SEVERAL VIEWS OF THE DRAWINGS

A more complete appreciation of the invention and the many attendant advantages thereof will be readily obtained as the same becomes better understood by reference to the following detailed description when considered in connection with the accompanying drawings, wherein.

DETAILED DESCRIPTION OF THE INVENTION

Figure 1:
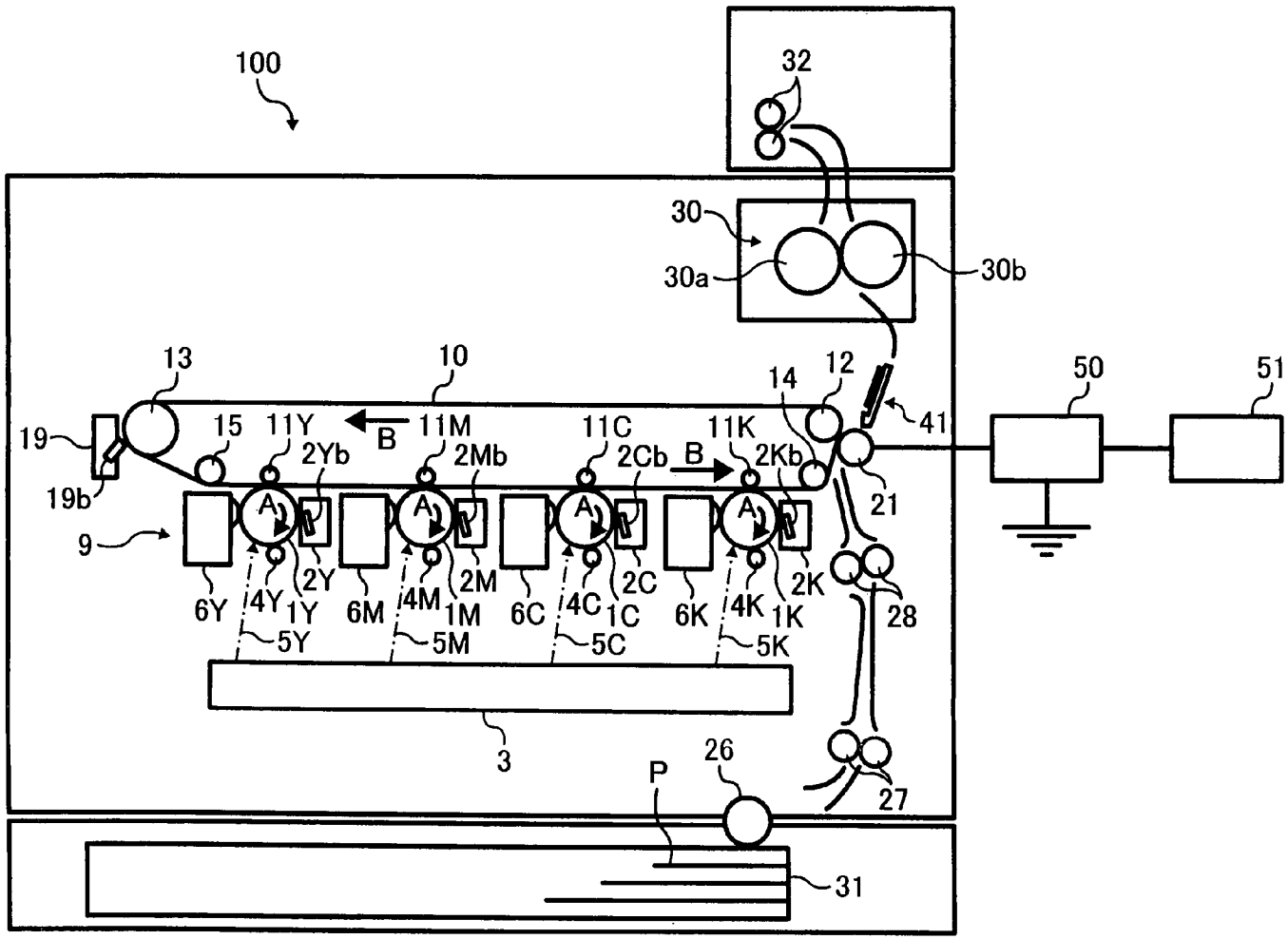
FIG. 1 is a schematic view of an image forming apparatus according to an exemplary embodiment of the present invention.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Referring now to the drawings, wherein like reference numerals designate identical or corresponding parts throughout the several views, in particular to FIG. 1, an image forming apparatus 100 according to an exemplary embodiment of the present invention is explained.

As illustrated in FIG. 1, the image forming apparatus 100 includes an image forming unit 9, an exposure unit 3, an intermediate transfer belt 10, first transfer bias rollers 11Y, 1M, 11C, and 11K, rollers 12, 13, 14, and 15, a paper tray 31, a pick-up roller 26, a feeding roller pair 27, a registration roller pair 28, a second transfer bias roller 21, a second transfer power source 50, a controller 51, a guide 41, a belt cleaner 19, a fixing unit 30, and an output roller pair 32. The image forming unit 9 includes photoconductors 1Y, 1M, 1C, and 1K, chargers 4Y, 4M, 4C, and 4K, development units 6Y, 6M, 6C, and 6K, and cleaners 2Y, 2M, 2C, and 2K. The cleaners 2Y, 2M, 2C, and 2K respectively include cleaning blades 2Yb, 2Mb, 2Cb, and 2Kb. The fixing unit 30 includes a fixing roller 30*a* and a pressing roller 30*b*. The belt cleaner 19 includes a cleaning blade 19*b*.

The image forming apparatus 100 may be a copying machine, a facsimile machine, a printer, a multifunction printer having copying, printing, scanning, and facsimile functions, or the like. According to this non-limiting exemplary embodiment of the present invention, the image forming apparatus 100 functions as a color printer for printing a color image on a recording medium using an electrophotographic method.

The image forming unit 9 forms toner images in yellow, magenta, cyan, and black colors. Each of the photoconductors 1Y, 1M, 1C, and 1K has a drum-like shape and rotates in a rotating direction A at a circumferential speed of about 150 mm/sec. The photoconductors 1Y, 1M, 1C, and 1K are disposed in the image forming apparatus 100 in such a manner that rotating shafts of the photoconductors 1Y, 1M, 1C, and 1K horizontally extend from the front to the back of the image forming apparatus 100. The rotating shafts of the photoconductors 1Y, 1M, 1C, and 1K are provided so as to be parallel to each other on the same horizontal plane.

The chargers 4Y, 4M, 4C, and 4K, the development units 6Y, 6M, 6C, and 6K, and the cleaners 2Y, 2M, 2C, and 2K are respectively disposed around the photoconductors 1Y, 1M, 1C, and 1K. The chargers 4Y, 4M, 4C, and 4K uniformly charge surfaces of the photoconductors 1Y, 1M, 1C, and 1K respectively. According to this non-limiting exemplary embodiment, each of the chargers 4Y, 4M, 4C, and 4K includes a charging roller (not shown) which contacts the surface of each of the photoconductors 1Y, 1M, 1C, and 1K and rotates while being driven by each of the rotating photoconductors 1Y, 1M, 1C, and 1K so as to charge the surface of each of the photoconductors 1Y, 1M, 1C, and 1K. However, the chargers 4Y, 4M, 4C, and 4K may be configured to respectively charge the surfaces of the photoconductors 1Y, 1M, 1C, and 1K without contacting the surfaces of the photoconductors 1Y, 1M, 1C, and 1K. A high-voltage power source (not shown) applies alternating and direct current biases to each of the chargers 4Y, 4M, 4C, and 4K. Thus, the chargers 4Y, 4M, 4C, and 4K uniformly charge the surfaces of the photoconductors 1Y, 1M, 1C, and 1K respectively so that each of the photoconductors 1Y, 1M, 1C, and 1K has a surface potential of about −500 V.

The exposure unit 3 is disposed under the image forming unit 9 and emits light 5Y, 5M, 5C, and 5K upward to irradiate the charged surfaces of the photoconductors 1Y, 1M, 1C, and 1K according to image data, resulting in formation of an electrostatic latent image on the surface of each of the photoconductors 1Y, 1M, 1C, and 1K. The image data includes yellow, magenta, cyan, and black image data. Namely, the exposure unit 3 irradiates with the light 5Y, 5M, 5C, and 5K the surfaces of the photoconductors 1Y, 1M, 1C, and 1K according to the yellow, magenta, cyan, and black image data to form electrostatic latent images corresponding to the yellow, magenta, cyan, and black image data, respectively. The exposure unit 3 may include a laser beam scanner using a laser diode.

The development units 6Y, 6M, 6C, and 6K respectively develop the electrostatic latent images formed on the surfaces of the photoconductors 1Y, 1M, 1C, and 1K with yellow, magenta, cyan, and black toners to form yellow, magenta, cyan, and black toner images. According to this non-limiting exemplary embodiment, each of the development units 6Y, 6M, 6C, and 6K develops the electrostatic latent image with a two-component non-magnetic developer including a toner. Specifically, each of the development units 6Y, 6M, 6C, and 6K includes a developing roller (not shown), which contacts each of the photoconductors 1Y, 1M, 1C, and 1K, for carrying the developer. A high-voltage power source (not shown) applies a predetermined developing bias to the developing roller so as to move the toner in the developer carried by the developing roller onto the electrostatic latent image formed on each of the photoconductors 1Y, 1M, 1C, and 1K. The toner adheres to the electrostatic latent image. Thus, a toner image corresponding to the electrostatic latent image forms on the surface of each of the photoconductors 1Y, 1M, 1C, and 1K.

The intermediate transfer belt 10 is disposed above the image forming unit 9. The yellow, magenta, cyan, and black toner images respectively formed on the surfaces of the photoconductors 1Y, 1M, 1C, and 1K are transferred onto the intermediate transfer belt 10 while superimposed to form a color toner image. The intermediate transfer belt 10 has an endless belt-like shape and is looped over the first transfer bias rollers 11Y, 1M, 11C, and 11K, and the rollers 12, 13, 14, and 15. A driving force is transmitted from a driver (not shown) to the roller 12 to drive and rotate the roller 12. The rotating roller 12 rotates the intermediate transfer belt 10 in a rotating direction B. Namely, the roller 12 supports and drives the intermediate transfer belt 10. However, any one of the other rollers may support and drive the intermediate transfer belt 10.

The intermediate transfer belt 10 includes one or more layers preferably including a material such as PVDFs (polyvinylidene fluoride), ETFEs (ethylene-tetrafluoroethylene copolymers), PIs (polyimide), and PCs (polycarbonate), in which a conductive material including carbon black and the like is dispersed to control the volume resistivity of the intermediate transfer belt 10 in a range of from about $10^8\Omega\cdot$cm to about $10^{12}\Omega\cdot$cm and the surface resistivity in a range of from about $10^8\Omega/\square$ to about $10^{15}\Omega/\square$. When the volume resistivity and the surface resistivity of the intermediate transfer belt 10 respectively exceed the above-described ranges, a higher transfer bias needs to be applied to the intermediate transfer belt 10, resulting in an increased power cost. Further, when a higher transfer bias is applied to the intermediate transfer belt 10, the electric potential of the intermediate transfer belt 10 increases to an extent which can not be reduced by self-discharge. Therefore, a discharging mechanism for discharging the intermediate transfer belt 10 is needed, resulting in increased manufacturing costs. When the volume resistivity and the surface resistivity of the intermediate transfer belt 10 do not respectively reach the above-described ranges, the electric potential of the intermediate transfer belt 10 can be decreased quickly by self-discharge. However, a transfer current, which flows when the toner image is transferred, may easily flow along a surface of the intermediate transfer belt 10, resulting in occurrence of toner scattering. Therefore, it is preferable for the intermediate transfer belt 10 to have the volume resistivity and the surface resistivity in the above-described ranges. The volume resistivity and the surface resistivity of the intermediate transfer belt 10 were measured by the following method:

(1) connecting an HRS probe having an inside electrode having a diameter of about 5.9 mm and a ring electrode having an interior diameter of about 11 mm to a high resistivity meter HIRESTA IP available from Mitsubishi Chemical Corporation; and (2) applying a voltage of about 100 V (i.e., about 500 V when measuring the surface resistivity) to the intermediate transfer belt 10 in the vertical direction (volume resistivity) or the horizontal direction (surface resistivity) to determine the current after about 10 seconds.

The intermediate transfer belt 10 may further include a releasing layer on the surface of the intermediate transfer belt 10, if necessary. The releasing layer may include fluoroplastic such as ETFEs, PTFEs (polytetrafluoroethylene), PVDFs, PFAs (perfluoroalkoxy resins), FEPs (tetrafluoroethylene-propylene fluoride copolymers), and PVFs (polyvinyl fluoride). However, the fluoroplastic is not limited thereto. The intermediate transfer belt 10 can be produced by a cast molding method, a centrifugal molding method, or the like. The surface of the intermediate transfer belt 10 may be polished, if necessary.

A high voltage power source (not shown) applies a first transfer bias to the first transfer bias rollers 11Y, 1M, 11C, and 11K over which the intermediate transfer belt 10 is looped. The first transfer bias rollers 11Y, 1M, 11C, and 11K contact an inner circumferential surface of the intermediate transfer belt 10 and respectively oppose the photoconductors 1Y, 1M, 1C, and 1K with the intermediate transfer belt 10 therebetween to each form a first transfer nip. The first transfer nips are respectively formed between the photoconductors 1Y, 1M, 1C, and 1K and an outer circumferential surface of the intermediate transfer belt 10. Each of the first transfer bias rollers 1Y, 1M, 11C, and 11K includes an elastic layer to form the first transfer nip. The first transfer bias rollers 11Y, 1M, 11C, and 11K perform a first transfer at the first transfer nips. Namely, the first transfer bias rollers 11Y, 1M, 11C, and 11K respectively transfer the yellow, magenta, cyan, and black toner images respectively formed on the surfaces of the photoconductors 1Y, 1M, 1C, and 1K onto the outer circumferential surface of the intermediate transfer belt 10 superimposing the toner images thereon.

The cleaners 2Y, 2M, 2C, and 2K respectively remove residual toners remaining on the surfaces of the photoconductors 1Y, 1M, 1C, and 1K after the yellow, magenta, cyan, and black toner images respectively formed on the surfaces of the photoconductors 1Y, 1M, 1C, and 1K are transferred onto the outer circumferential surface of the intermediate transfer belt 10. The cleaning blades 2Yb, 2Mb, 2Cb, and 2Kb contact the surfaces of the respective photoconductors 1Y, 1M, 1C, and 1K to scrape the residual toner remaining on the surfaces of the photoconductors 1Y, 1M, 1C, and 1K.

The paper tray 31 is loaded with a recording medium (e.g., sheets P). The pick-up roller 26 feeds a sheet P from the paper tray 31 toward the feeding roller pair 27. The feeding roller pair 27 further feeds the sheet P toward the registration roller pair 28.

The second transfer bias roller 21 contacts the outer circumferential surface of the intermediate transfer belt 10 and opposes the roller 12 via the intermediate transfer belt 10 to form a second transfer nip. The second transfer nip is formed between the second transfer bias roller 21 and the outer circumferential surface of the intermediate transfer belt 10. The registration roller pair 28 feeds the sheet P to the second transfer nip such that the color toner image formed on the outer circumferential surface of the intermediate transfer belt 10 is transferred to the proper position of the sheet P at the second transfer nip. The second transfer bias roller 21 performs second transfer at the second transfer nip. Namely, the second transfer bias roller 21 transfers the color toner image formed on the outer circumferential surface of the intermediate transfer belt 10 onto the sheet P at the second transfer nip.

The second transfer bias roller 21 is connected to the second transfer power source 50. The second transfer power source 50 applies a second transfer bias to the second transfer bias roller 21. The second transfer power source 50 is connected to the controller 51 for controlling the second transfer bias. The second transfer bias roller 21 includes a core and an elastic layer coated on the core. The core includes a metal (e.g., stainless steel SUS and/or the like). The elastic layer includes polyurethane and a conductive material, and has a resistivity in a range of from about $10^6\Omega$ to about $10^{10}\Omega$. When the resistivity of the second transfer bias roller 21 exceeds the above-described range, a transfer current may not easily flow and a higher voltage needs to be applied to the second transfer bias roller 21 to well perform image transferring, resulting in an increased power cost. Further, when a higher voltage is applied to the second transfer bias roller 21, discharge may occur in spaces just before or after the second transfer nip in a sheet conveyance direction, resulting in formation of white spots on a halftone image. When the resistivity of the second transfer bias roller 21 does not reach the above-described range, image transferring cannot be performed well, particularly when the image includes both an image formed by superimposing a plurality of different color toner images and a single color toner image. The reason therefore is as follows. When the resistivity of the second transfer bias roller 21 is low, and a low voltage is applied as the second transfer bias to effectively transfer the portion of the image formed by the single color toner image, a proper transfer current sufficient for properly transferring the portion of the image formed by superimposing the plurality of the different color toner images cannot be flown. In contrast, application of a high voltage as the second transfer bias may provide a transfer current sufficient for transferring the portion of the image formed by superimposing the plurality of the different color toner images, but may not provide a proper transfer current for the portion of the image formed by the single color toner image due to excessive transfer current flow, resulting in decreased transfer efficiency. The resistivity of the second transfer bias roller 21 is calculated based on a current flown when a voltage of about 1,000 V is applied between the core and a conductive metal plate, wherein a load of about 4.9 N (i.e., the both ends of the core receive a total load of about 9.8 N) is applied to each of the ends of the core of the second transfer bias roller 21.

A driving gear (not shown) drives and rotates the second transfer bias roller 21 at a circumferential speed similar to the circumferential speed of the intermediate transfer belt 10. The second transfer bias roller 21 rotates in a rotating direction such that the second transfer bias roller 21 is driven by the rotating intermediate transfer belt 10.

The second transfer bias roller 21 and the intermediate transfer belt 10 feed the sheet P, which bears the color toner image transferred from the outer circumferential surface of the intermediate transfer belt 10 at the second transfer nip, toward the guide 41. The guide 41 includes discharging teeth (described below) at a head of the guide 41. The discharging teeth discharge the charges of the sheet P. The guide 41 separates the sheet P from the intermediate transfer belt 10 and guides the sheet P toward the fixing unit 30.

In the fixing unit 30, the sheet P is fed toward a fixing nip formed between the fixing roller 30*a* and the pressing roller 30*b*. At the fixing nip, the fixing roller 30*a* and the pressing roller 30*b* apply heat and pressure to the sheet P bearing the color toner image to fix the color toner image on the sheet P. Each of the fixing roller 30*a* and the pressing roller 30*b* has a surface resistivity not lower than about $10^7\Omega/\square$ and a volume resistivity not lower than about $10^7\Omega\cdot$cm. The fixing roller 30*a* and the pressing roller 30*b* feed the sheet P bearing the fixed color toner image toward the output roller pair 32. The output roller pair 32 feeds the sheet P to outside of the image forming apparatus 100.

The belt cleaner 19 opposes the roller 13 via the intermediate transfer belt 10. The belt cleaner 19 removes a residual toner remaining on the outer circumferential surface of the intermediate transfer belt 10 even after the color toner image formed on the outer circumferential surface of the intermediate transfer belt 10 is transferred onto the sheet P. The cleaning blade 19*b* contacts the outer circumferential surface of the intermediate transfer belt 10 to scrape the residual toner off the outer circumferential surface of the intermediate transfer belt 10.

According to this non-limiting exemplary embodiment, a user may specify a monochrome mode, a two-color mode, a three-color mode, or a full-color mode on a control panel (not shown) of the image forming apparatus 100. The monochrome mode forms an image by using any one of yellow, magenta, cyan, and black toner images. The two-color mode forms an image by superimposing any two of yellow, magenta, cyan, and black toner images. The three-color mode forms an image by superimposing any three of yellow, magenta, cyan, and black toner images. The full-color mode forms an image by superimposing yellow, magenta, cyan, and black toner images.

According to this non-limiting exemplary embodiment, the image forming apparatus 100 uses a polymerized toner produced by a polymerization method. The polymerized toner may preferably have a shape factor SF-1 in a range of from about 100 to about 180 and a shape factor SF-2 in a range of from about 100 to about 180.

Figure 2:
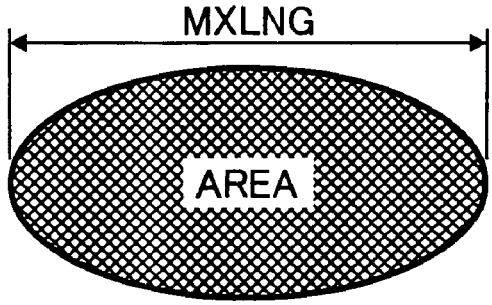
FIG. 2 is an explanatory drawing for describing the shape factor SF-1 of a toner particle.

FIG. 2 is an explanatory drawing for describing the shape factor SF-1 of a toner particle. The shape factor SF-1 indicates a degree of sphericity of the toner particle and is represented by an equation 1 below. The shape factor SF-1 (i.e., C in the equation 1) of the toner particle is calculated by squaring a maximum length MXLNG (i.e., D in the equation 1) of the toner particle projected on a two-dimensional plane, dividing the squared value by an area AREA (i.e., E in the equation 1) of the projected toner particle, and multiplying the divided value by $100\times4\pi$. When the shape factor SF-1 is 100, the toner particle has a spherical shape. The greater the shape factor SF-1 is, the more amorphous shape the toner particle has.

$$C=(D^2/E)\times(100\times4\pi)$$

Equation 1

Figure 3:
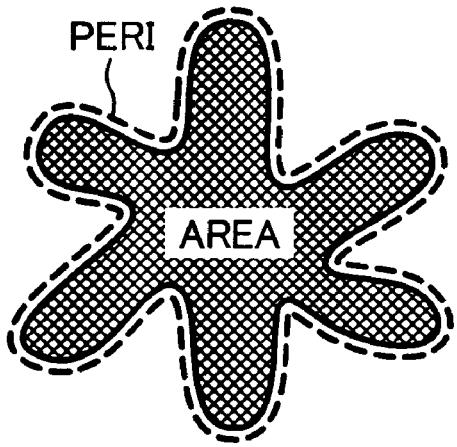
FIG. 3 is an explanatory drawing for describing the shape factor SF-2 of a toner particle.

FIG. 3 is an explanatory drawing for describing the shape factor SF-2 of a toner particle. The shape factor SF-2 indicates a degree of concavity and convexity of the toner particle and is represented by an equation 2 below. The shape factor SF-2 (i.e., F in the equation 2) of a toner particle is calculated by squaring a peripheral length PERI (i.e., G in the equation 2) of the toner particle projected on a two-dimensional plane, dividing the squared value by an area AREA (i.e., H in the equation 2) of the projected toner particle, and multiplying the divided value by $100\times4\pi$. When the shape factor SF-2 is 100, a surface of the toner particle has no concavity and convexity. The greater the shape factor SF-2 of a toner is, the more roughened surface the toner has.

$$F=(G^2/H)\times(100\times4\pi) \quad \text{Equation 2}$$

The shape factors SF-1 and SF-2 of a toner are determined by photographing the toner particles with a scanning electron microscope S-800 available from Hitachi, Ltd. and analyzing the photographed images with an image analyzer LUZEX III available from NIRECO Corporation.

When toner particles have a sphere-like shape, the toner particles contact each other at a small area. Namely, the toner particles nearly make point-contact with each other and therefore the attracting force between the toner particles becomes weaker. As a result, the fluidity of the toner particles becomes greater. The toner particles also contact the surface of each of the photoconductor 1Y, 1M, 1C, and 1K and the intermediate transfer belt 10 at a small area. Namely, the toner particles nearly make point-contact with the surface of each of the photoconductors 1Y, 1M, 1C, and 1K and the intermediate transfer belt 10 and the attracting force between the toner particles and each of the photoconductors 1Y, 1M, 1C, and 1K and the intermediate transfer belt 10 becomes weaker. As a result, the toner particles can be transferred onto and from the intermediate transfer belt 10 at an increased transfer rate. When any one of the shape factors SF-1 and SF-2 exceeds 180, the toner particle may be transferred onto and from the intermediate transfer belt 10 at a decreased transfer rate. Further, the toner particles adhered to the intermediate transfer belt 10 cannot be easily removed therefrom.

The toner for use in the image forming apparatus 100 of the present invention preferably has a volume average particle size in a range of from about 4 μm to about 10 μm. When the toner has a particle size smaller than the above-described range, it can easily cause a background development problem. In particular, the toner particles can stain the sheet P. In addition, the toner particles have a decreased flowability and easily agglomerate, thereby forming hollow images. In contrast, when the toner has a particle size greater than the above-described range, the toner particles scatter and resolution of an image deteriorates, (i.e., a high-resolution image cannot be formed). According to this non-limiting exemplary embodiment, the image forming apparatus 100 uses toner particles having a volume average particle size of about 6.5 μm.

Figure 4:
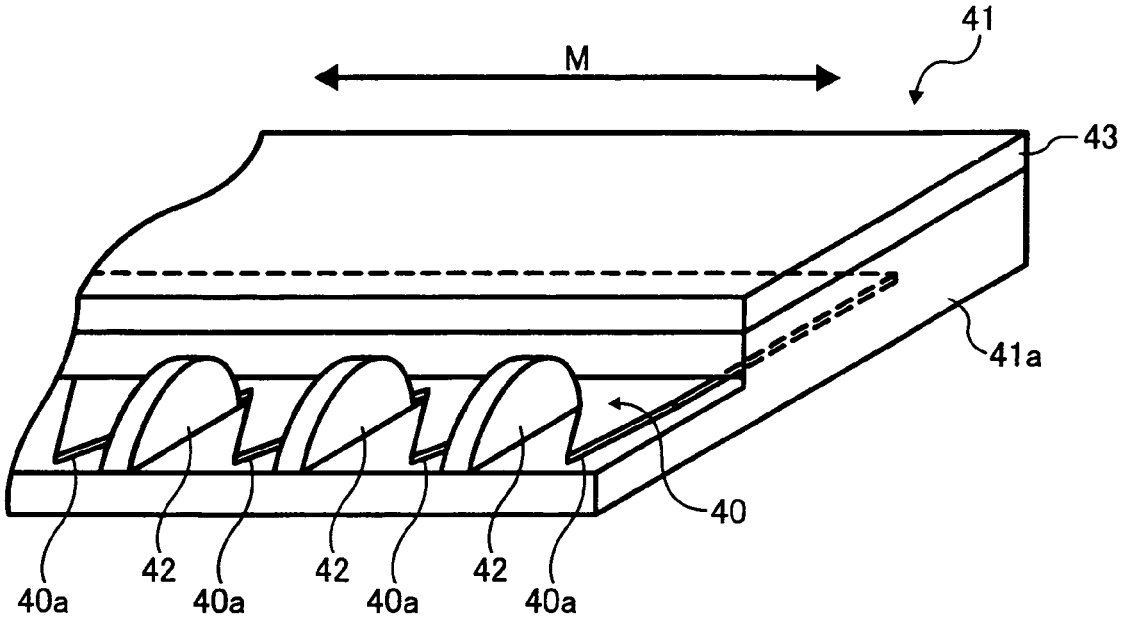
FIG. 4 is a perspective view of a guide included in the image forming apparatus shown in FIG. 1.

As illustrated in FIG. 4, the guide 41 includes a base 41*a*, ribs 42, a discharging plate 40, and a guide sheet 43. The discharging plate 40 includes discharging teeth 40*a*.

The base 41*a* includes a low-cost insulating material such as ABS (acrylonitrile-butadiene-styrene) resins. The ribs 42 include a plurality of insulating ribs integrally molded with the base 41*a*. The discharging plate 40 includes a plurality of discharging teeth 40*a* having a protruding shape. The guide sheet 43 is disposed on the base 41*a*. The discharging plate 40 is connected to a power source (not shown) for applying a discharging bias having the same polarity (i.e., a polarity opposite to a polarity of the second transfer bias) as the polarity of the toner used. According to this non-limiting exemplary embodiment, the discharging bias has a negative polarity. The power source applies the discharging bias to the discharging plate 40 so that a tip of each of the discharging teeth 40*a* causes corona discharge to discharge the backside of the sheet P which has passed the second transfer nip and which bears a toner image transferred from the intermediate transfer belt 10 on its front side.

Figure 5:
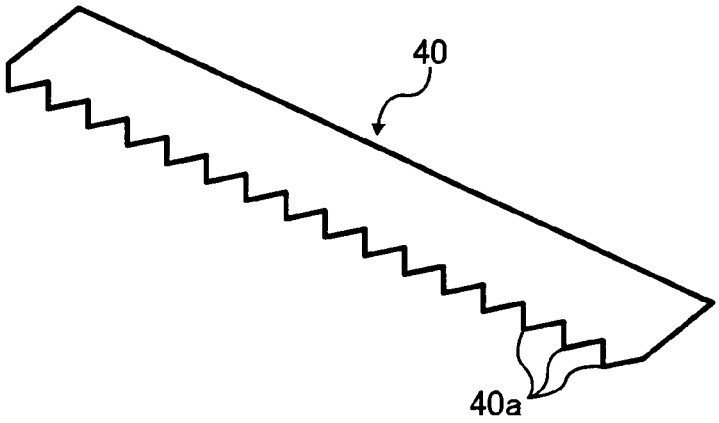
FIG. 5 is a perspective view of a discharging plate included in the guide shown in FIG. 4.

As illustrated in FIG. 5, the discharging plate 40 includes stainless steel SUS having a rectangle-like shape and a thickness of about 0.2 mm. One side edge of the discharging plate 40 has a serrated shape (i.e., the discharging teeth 40*a*). According to this non-limiting exemplary embodiment, the pitch between two adjacent discharging teeth 40*a* is about 3 mm. As illustrated in FIG. 4, a part of the discharging plate 40 other than the discharging teeth 40*a* is placed inside the base 41*a*. The ribs 42 are integrally molded with the base 41*a* and each of the ribs 42 is disposed between two adjacent discharging teeth 40*a*. The ribs 42 protrude in a direction perpendicular to a longitudinal direction M of the discharging plate 40. Namely, the ribs 42 protrude along a normal line of a surface of the discharging plate 40. Thus, when the guide 41 is disposed near and downstream from the second transfer nip in the sheet conveyance direction, the ribs 42 protrude farther than the discharging teeth 40*a* toward the backside of the sheet P.

The guide sheet 43 is disposed on the base 41*a* and contacts the sheet P. The guide sheet 43 is attached to the base 41*a* with a double-faced adhesive tape. The guide sheet 43 includes a material for charging the sheet P to have the same polarity as the polarity of the second transfer bias, that is, a polarity opposite to the polarity of the toner on the sheet P, by friction between the guide sheet 43 and the sheet P.

Figure 6:
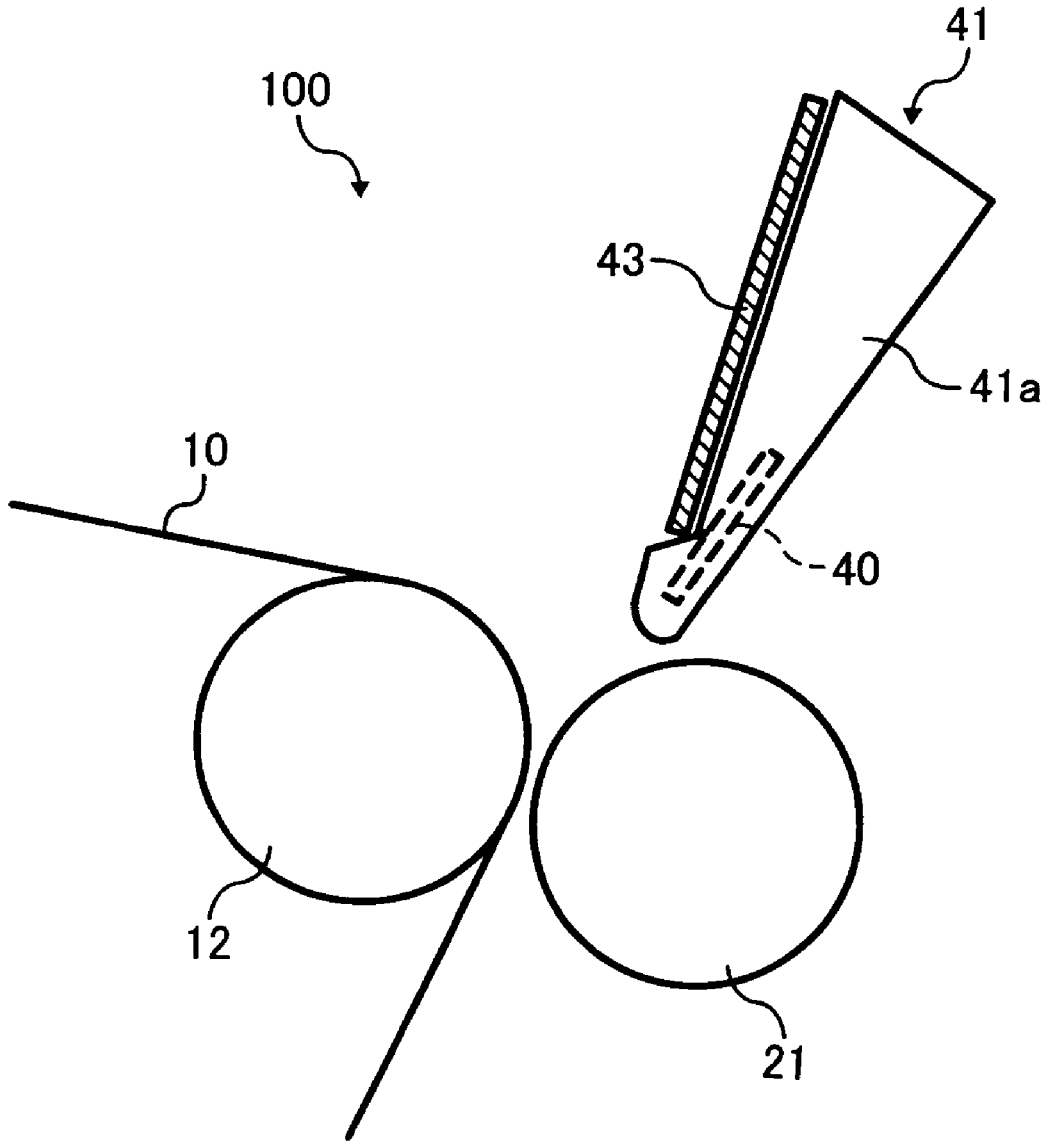
FIG. 6 is a schematic view illustrating the guide shown in FIG. 4 disposed with respect to a second transfer bias roller and a second transfer nip included in the image forming apparatus shown in FIG. 1.

As illustrated in FIG. 6, the guide 41 is disposed downstream from the second transfer nip in the sheet conveyance direction in such a manner that the longitudinal direction of the discharging plate 40 is perpendicular to the sheet conveyance direction and is parallel to a direction to which a shaft of the second transfer bias roller 21 extends. As further illustrated in FIG. 6, the guide sheet 43 is disposed downstream from the ribs 42 (depicted in FIG. 4) in the sheet conveyance direction. Thus, the insulating base 41*a* can shield the discharging plate 40 from the second transfer bias roller 21. As a result, when the power source applies the discharging bias to the discharging plate 40, the discharging teeth 40*a* (depicted in FIG. 4) can stably cause corona discharge without being affected by the second transfer bias roller 21.

The sheet P discharged by the discharging teeth 40*a* separates from the intermediate transfer belt 10 and contacts the guide sheet 43. The sheet P scrubs the guide sheet 43 while the sheet P is conveyed from the second transfer nip toward the fixing unit 30 (depicted in FIG. 1). The scrub generates friction between the sheet P and the guide sheet 43 and charges the sheet P to have the polarity opposite to the polarity of the toner (i.e., a positive polarity in this non-limiting exemplary embodiment). Namely, the backside of the sheet P carries an increased amount of electric charge with the polarity opposite to the polarity of the toner. Thus, the sheet P can electrostatically carry the toner image stably. As a result, when the sheet P contacts the fixing roller 30*a* (depicted in FIG. 1), scatter of the toner from the sheet P onto the fixing roller 30*a* can be suppressed.

The following describes test results showing a relationship between a surface resistivity of the guide sheet 43 and an amount of toner scattered from a sheet P, when the guide sheet 43 includes a polycarbonate. A plurality of guide sheets having different surface resistivities were prepared by changing the amount of carbon black in the polycarbonate. The plurality of guide sheets were left overnight in different environments. An image forming operation was performed in a test image forming apparatus not using the guide sheet 43 and in test image forming apparatuses using different guide sheets. Whether or not the toner scattered from the sheet P onto the fixing roller 30*a* was visually checked. Table 1 illustrates the test results.

TABLE 1

| Temperature/ humidity | Surface resistivity of guide sheet 43 (Ω/□) Without guide sheet 43 | $10^7$ | $10^8$ | $10^9$ | $10^{10}$ | $10^{14}$ | $10^{16}$ |
|---|---|---|---|---|---|---|---|
| 10° C./15% | Y | N | N | N | N | N | N |
| 23° C./50% | N | S | N | N | N | N | N |
| 27° C./80% | N | Y | Y | N | N | N | N |

In the above table, character N represents that the toner did not scatter from the sheet P onto the fixing roller 30*a*. Character S represents that the toner slightly scattered from the sheet P onto the fixing roller 30*a*. Character Y represents that the toner scattered from the sheet P onto the fixing roller 30*a*. "Without guide sheet 43" means that tests were performed in the test image forming apparatus which does not include the guide sheet 43 but includes the base 41*a* including an ABS resin and having a surface resistivity of $10^{14}$Ω/□.

As illustrated in Table 1, in the test image forming apparatus not including the guide sheet 43, the toner scattered from the sheet P onto the fixing roller 30*a* under a low temperature and low humidity condition of 10° C. and 15% RH. The toner scattered because friction between the sheet P and the base 41*a* including the ABS resin charged the sheet P to have the same polarity as the polarity of the toner on the sheet P when the sheet P scrubbed the base 41*a*. As a result, friction between the sheet P and the base 41*a* decreased the amount of electric charge on the sheet P having the polarity opposite to the polarity of the toner on the sheet P when the sheet P bearing a toner image transferred from the intermediate transfer belt 10 was conveyed toward the fixing unit 30 while scrubbing the base 41*a*. Thus, the sheet P had a decreased force for electrostatically attracting the toner. In the low temperature and low humidity environment, friction between the sheet P and the base 41*a* increased the amount of electric charge on the sheet P having the same polarity as the polarity of the toner on the sheet P. The sheet P could not electrostatically attract the toner. Therefore, the toner scattered from the sheet P onto the fixing roller 30*a* while the sheet P was conveyed in the fixing unit 30 and then the scattered toner was adhered to the sheet P again.

When the guide sheet 43 including the polycarbonate was used, the toner did not scatter from the sheet P onto the fixing roller 30*a* even in the low temperature and low humidity environment. The reason the toner did not scatter from the sheet P onto the fixing roller 30*a* is that the polycarbonate charged the sheet P to have the polarity opposite to the polarity of the toner on the sheet P by friction between the sheet P and the guide sheet 43 when the sheet P scrubbed the guide sheet 43. As a result, when the sheet P bearing a toner image transferred from the intermediate transfer belt 10 was conveyed toward the fixing unit 30 while scrubbing the guide sheet 43, friction between the sheet P and the guide sheet 43 increased the amount of electric charge on the sheet P having the polarity opposite to the polarity of the toner on the sheet P. Thus, the sheet P had an increased force for electrostatically attracting the toner. Therefore, even in the low temperature and low humidity environment, when the sheet P was conveyed in the fixing unit 30, the toner did not scatter from the sheet P onto the fixing roller 30*a*.

When the guide sheet 43 had the surface resistivity of $10^7$Ω/□ or $10^8$Ω/□, the toner scattered from the sheet P onto the fixing roller 30*a* in a high temperature and high humidity environment of 27° C. and 80% RH. Since the guide sheet 43 has a low surface resistivity and electric currents flow easily in the high temperature and high humidity environment, the electric charge with the polarity opposite to the polarity of the toner on the sheet P was transferred from the sheet P to the guide sheet 43 while the sheet P contacted the guide sheet 43 . . . . Thus, as the sheet P was conveyed toward the fixing unit 30, the amount of the electric charge having the polarity opposite to the polarity of the toner on the sheet P decreased. As a result, the sheet P had a decreased force for electrostatically attracting the toner and thereby the toner scattered from the sheet P onto the fixing roller 30*a*.

When the guide sheet 43 had the surface resistivity of $10^9$Ω/□ or higher, the toner did not scatter from the sheet P onto the fixing roller 30*a* in any environment. The reason therefor is considered to be that the electric charge was not transferred from the sheet P to the guide sheet 43 even in the high temperature and high humidity environment. As a result, the sheet P maintained a force for electrically attracting the toner and the toner did not scatter from the sheet P onto the fixing roller 30*a*.

The guide sheet 43 can include a PET (polyethylene terephthalate). Tests were performed with test image forming apparatuses including the guide sheet 43 made of a PET in such a manner as described above for the case using the guide sheet 43 made of a PC (polycarbonate). The test results showed that, similar to the above-mentioned case, the toner did not scatter from the sheet P onto the fixing roller 30*a* in any environment when the guide sheet 43 had the surface resistivity of $10^9$Ω/□ or higher.

The guide sheet 43 can include a PVDF (polyvinylidene fluoride). Tests were performed with test image forming apparatuses including the guide sheet 43 made of a PVDF in such a manner as described above for the case using the guide sheet 43 made of a PC. The test results showed that, similar to the above-mentioned case, the toner did not scatter from the sheet P onto the fixing roller 30*a* in any environment when the guide sheet 43 had the surface resistivity of $10^9$Ω/□ or higher.

Figure 7:
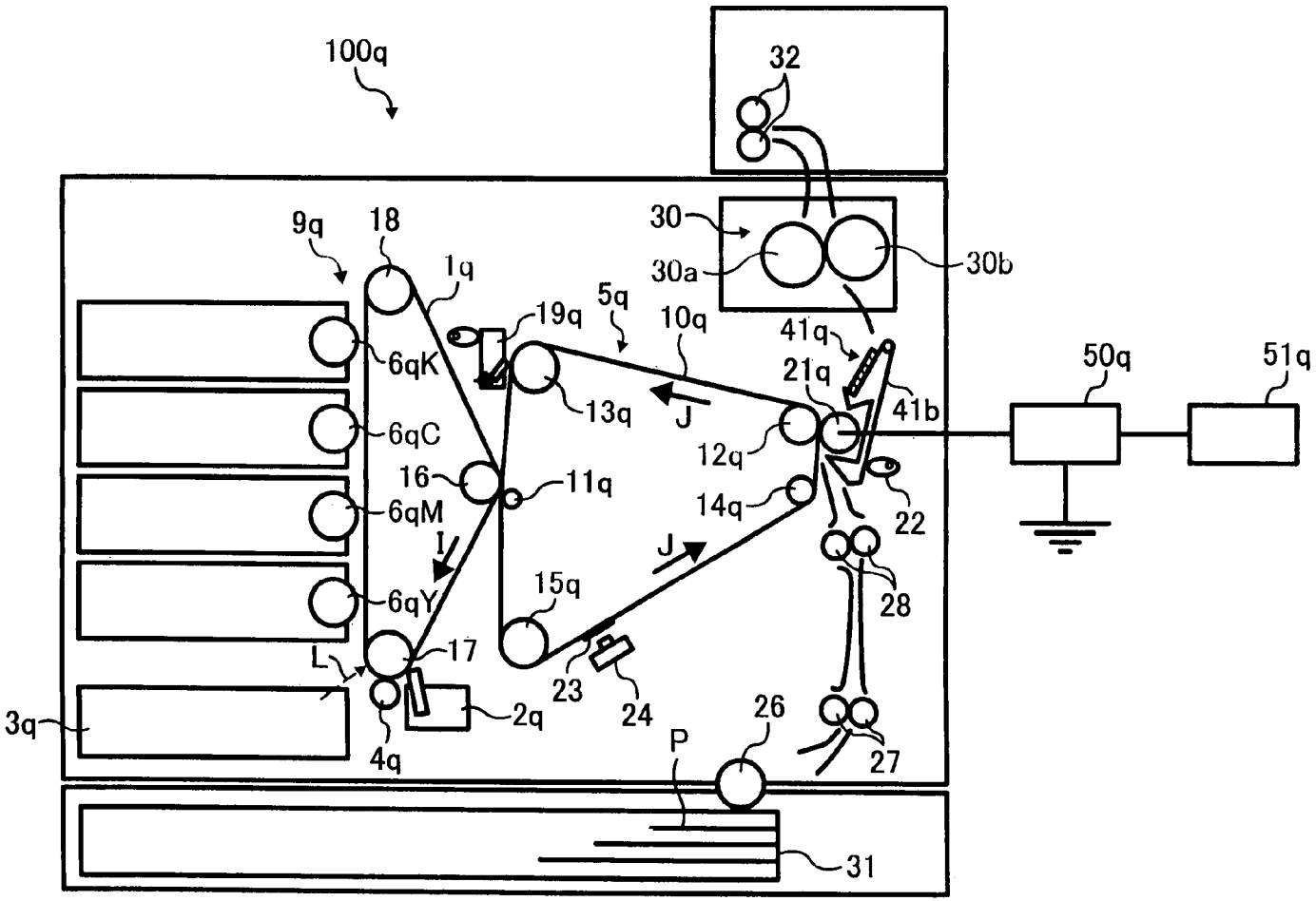
FIG. 7 is a schematic view of an image forming apparatus according to another exemplary embodiment of the present invention.

FIG. 7 illustrates an image forming apparatus 100*q* according to another exemplary embodiment of the present invention. The image forming apparatus 100*q* includes an image forming unit 9*q*, an exposure unit 3*q*, an intermediate transfer belt unit 5*q*, a second transfer bias roller 21*q*, a contact-separate mechanism 22, the paper tray 31, the pick-up roller 26, the feeding roller pair 27, the registration roller pair 28, a second transfer power source 50*q*, a controller 51*q*, a belt cleaner 19*q*, a guide 41*q*, the fixing unit 30, and the output roller pair 32. The image forming unit 9*q* includes a photoconductive belt 1*q*, a driving roller 18, driven rollers 16 and 17, a charger 4*q*, development units 6*q*Y, 6*q*M, 6*q*C, and 6*q*K, and a cleaner 2*q*. The intermediate transfer belt unit 5*q* includes an intermediate transfer belt loq, a first transfer bias roller 11*q*, a driving roller 15*q*, driven rollers 12*q*, 13*q*, and 14*q*, a mark sensor 23, and a sensor 24. The guide 41*q* includes a base 41*b*. The fixing unit 30 includes the fixing roller 30*a* and the pressing roller 30*b*.

The image forming apparatus 100*q* may be a copying machine, a facsimile machine, a printer, a multifunction printer having copying, printing, scanning, and facsimile functions, or the like. According to this non-limiting exemplary embodiment of the present invention, the image forming apparatus 100*q* functions as a color printer for printing a color image on a recording medium using the electrophotographic method.

The image forming unit 9*q* forms toner images in yellow, magenta, cyan, and black colors. The photoconductive belt 1*q* has a belt-like shape and is looped over the driving roller 18 and the driven rollers 16 and 17. A driver (not shown) drives and rotates the driving roller 18. The rotating driving roller 18 rotates the photoconductive belt 1$q$ in a rotating direction I. The rotating photoconductive belt 1$q$ rotates the driven rollers 16 and 17.

The charger 4$q$, the exposure unit 3$q$, the development units 6$q$Y, 6$q$M, 6$q$C, and 6$q$K, the intermediate transfer belt unit 5$q$, and the cleaner 2$q$ are disposed around the photoconductive belt 1$q$. The charger 4$q$ uniformly charges a surface of the photoconductive belt 1$q$. The exposure unit 3$q$ emits light L onto the charged surface of the photoconductive belt 1$q$ according to image data so as to form electrostatic latent images on the surface of the photoconductive belt 1$q$. The development units 6$q$Y, 6$q$M, 6$q$C, and 6$q$K respectively develop the electrostatic latent images formed on the surface of the photoconductive belt 1$q$ with yellow, magenta, cyan, and black toners to form yellow, magenta, cyan, and black toner images.

The intermediate transfer belt unit 5$q$ carries the yellow, magenta, cyan, and black toner images transferred from the photoconductive belt 1$q$. The intermediate transfer belt 10$q$ has an endless belt-like shape and is looped over the first transfer bias roller 11$q$, the driving roller 15$q$, and the driven rollers 12$q$, 13$q$, and 14$q$. A driver (not shown) drives and rotates the driving roller 15$q$ and the rotating driving roller 15$q$ rotates the intermediate transfer belt 10$q$ in a rotating direction J. The rotating intermediate transfer belt 10$q$ rotates the driven rollers 12$q$, 13$q$, and 14$q$. The first transfer bias roller 11$q$ opposes the driven roller 16 via the intermediate transfer belt 10$q$ and the photoconductive belt 1$q$ so that the intermediate transfer belt 10$q$ and the photoconductive belt 1$q$ contact each other. A first transfer nip is formed between the intermediate transfer belt 10$q$ and the photoconductive belt 1$q$. The first transfer bias roller 11$q$ performs first transfer at the first transfer nip. Namely, the first transfer bias roller 11$q$ transfers the yellow, magenta, cyan, and black toner images formed on the surface of the photoconductive belt 1$q$ onto an outer circumferential surface of the intermediate transfer belt 10$q$ to superimpose the toner images thereon. Thus, a color toner image is formed on the outer circumferential surface of the intermediate transfer belt 10$q$. The mark sensor 23 is provided on the outer circumferential surface of the intermediate transfer belt 10$q$. The sensor 24 detects the mark sensor 23 so that an image forming process for forming each of the yellow, magenta, cyan, and black toner images starts at a proper time based on the detection result. Thus, the yellow, magenta, cyan, and black toner images can be properly superimposed on the outer circumferential surface of the intermediate transfer belt 10$q$. The cleaner 2$q$ removes a residual toner remaining on the surface of the photoconductive belt 1$q$ even after the toner images formed on the surface of the photoconductive belt 1$q$ are transferred onto the outer circumferential surface of the intermediate transfer belt 10$q$.

The second transfer bias roller 21$q$ opposes the driven roller 12$q$ via the intermediate transfer belt 10$q$ to form a second transfer nip. A driving gear (not shown) drives the second transfer bias roller 21$q$ to rotate the second transfer bias roller 21$q$ at a circumferential speed substantially the same as the intermediate transfer belt 10$q$. The base 41$b$ of the guide 41$q$ holds a part of the second transfer bias roller 21$q$. The contact-separate mechanism 22 causes the second transfer bias roller 21$q$ to contact to and separate from the intermediate transfer belt 10$q$ via the base 41$b$.

The pick-up roller 26 and the feeding roller pair 27 feed a sheet P from the paper tray 31 toward the registration roller pair 28. The registration roller pair 28 feeds the sheet P to the second transfer nip at a time when a foremost head of the color toner image formed by the superimposed yellow, magenta, cyan, and black toner images on the outer circumferential surface of the intermediate transfer belt 10$q$ enters the second transfer nip. The contact-separate mechanism 22 presses the second transfer bias roller 21$q$ onto the sheet P so that the second transfer bias roller 21$q$ contacts the sheet P at a time when the second transfer bias roller 21$q$ transfers the color toner image from the intermediate transfer belt 10$q$ onto the sheet P. The second transfer bias roller 21$q$ separates from the intermediate transfer belt 10$q$ when the second transfer bias roller 21$q$ does not perform the transfer operation. Specifically, a predetermined bias voltage is applied to the second transfer bias roller 21$q$. The contact-separate mechanism 22 presses the second transfer bias roller 21$q$ onto the sheet P so that the second transfer bias roller 21$q$ contacts the backside of the sheet P (the backside does not face the intermediate transfer belt 10$q$). The second transfer bias roller 21$q$ applies a second transfer bias to the sheet P to transfer the color toner image from the intermediate transfer belt 10$q$ onto the sheet P. The second transfer bias roller 21$q$ is connected to the second transfer power source 50$q$. The second transfer power source 50$q$ applies the second transfer bias to the second transfer bias roller 21$q$. The second transfer power source 50$q$ is connected to the controller 51$q$ for controlling the second transfer bias.

The belt cleaner 19$q$ opposes the driven roller 13$q$ via the intermediate transfer belt loq and removes a residual toner remaining on the outer circumferential surface of the intermediate transfer belt 10$q$ after the color toner image formed on the outer circumferential surface of the intermediate transfer belt 10$q$ is transferred onto the sheet P. The guide 41$q$ guides the sheet P bearing the color toner image toward the fixing unit 30.

In the fixing unit 30, the sheet P is fed toward the fixing nip formed between the fixing roller 30$a$ and the pressing roller 30$b$, which oppose each other. At the fixing nip, the fixing roller 30$a$ and the pressing roller 30$b$ apply heat and pressure to the sheet P bearing the color toner image to fix the color toner image on the sheet P. The fixing roller 30$a$ and the pressing roller 30$b$ feed the sheet P bearing the fixed color toner image thereon toward the output roller pair 32. The output roller pair 32 feeds the sheet P to outside of the image forming apparatus 10$q$.

The guide 41$q$ is disposed near and downstream from the second transfer nip in the sheet conveyance direction. The guide 41$q$ includes the same structure as the guide 41 (depicted in FIGS. 4 and 6). Therefore, even when the sheet P scrubs the guide 41$q$ while the sheet P is guided by the guide 41$q$ and conveyed toward the fixing unit 30, friction between the sheet P and the guide 41$q$ cannot decrease the amount of electric charge having the polarity opposite to the polarity of the toner on the sheet P. As a result, scatter of the toner from the sheet P onto the fixing roller 30$a$ can be substantially suppressed when the sheet P is conveyed in the fixing unit 30.

Figure 8:
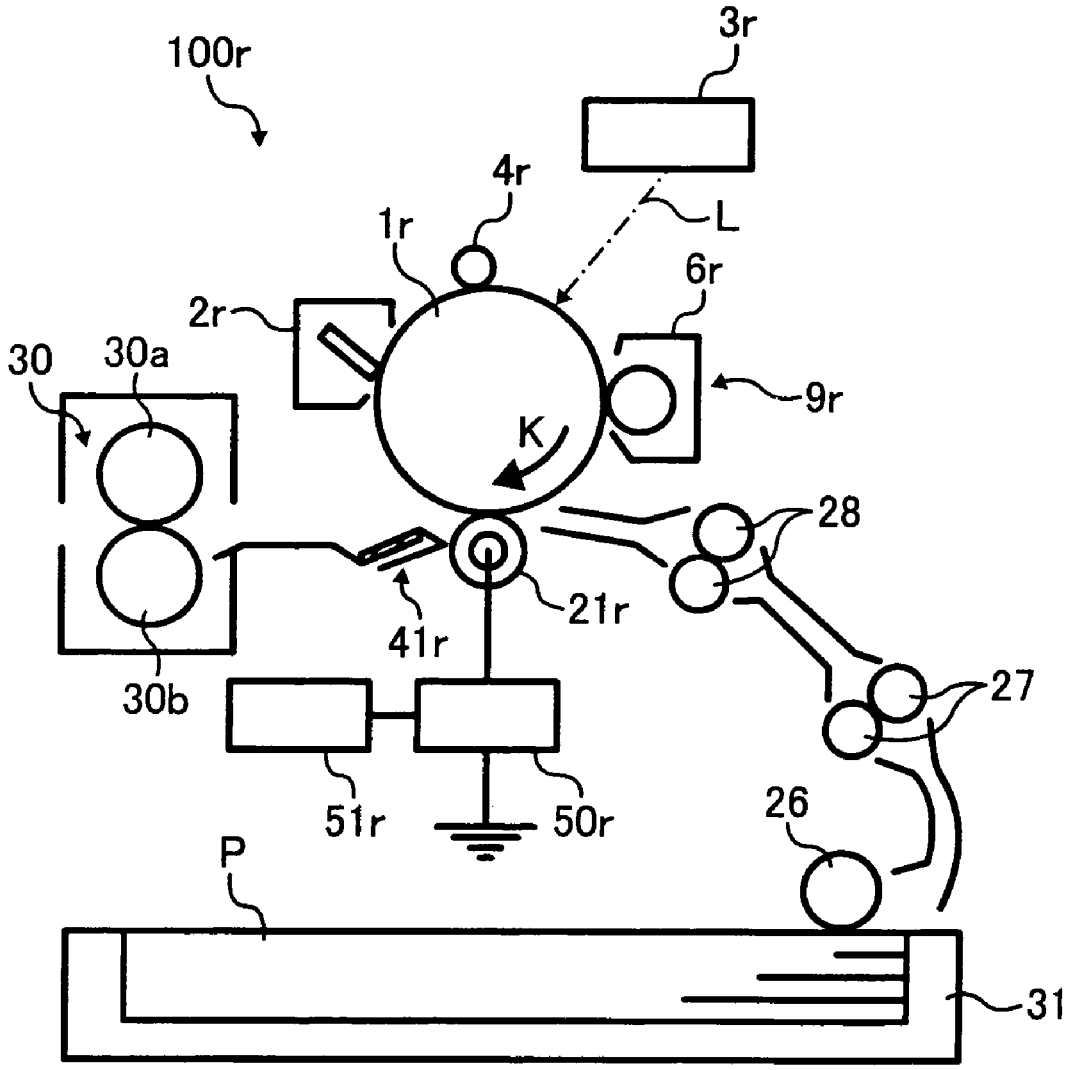
FIG. 8 is a schematic view of an image forming apparatus according to yet another exemplary embodiment of the present invention.

FIG. 8 illustrates an image forming apparatus 100$r$ according to yet another exemplary embodiment of the present invention. The image forming apparatus 100$r$ includes an image forming unit 9$r$, an exposure unit 3$r$, a transfer bias roller 21$r$, the paper tray 31, the pick-up roller 26, the feeding roller pair 27, the registration roller pair 28, a transfer power source 50$r$, a controller 51$r$, a guide 41$r$, and the fixing unit 30. The image forming unit 9$r$ includes a photoconductor 1$r$, a charger 4$r$, a development unit 6$r$, and a cleaner 2$r$. The fixing unit 30 includes the fixing roller 30$a$ and the pressing roller 30$b$.

The image forming apparatus 100$r$ may be a copying machine, a facsimile machine, a printer, a multifunction printer having copying, printing, scanning, and facsimile functions, or the like. According to this non-limiting exemplary embodiment of the present invention, the image forming apparatus 100*r* functions as a printer for printing a monochrome image on a recording medium using the electrophotographic method.

The image forming unit 9*r* forms a toner image. The photoconductor 1*r* has a drum-like shape and rotates in a rotating direction K. The charger 4*r*, the exposure unit 3*r*, the development unit 6*r*, the transfer bias roller 21*r*, and the cleaner 2*r* are disposed around the photoconductor 1*r*. The charger 4*r* uniformly charges a surface of the photoconductor 1*r*. The exposure unit 3*r* emits light L onto the charged surface of the photoconductor 1*r* according to image data so as to form an electrostatic latent image on the surface of the photoconductor 1*r*. The development unit 6*r* develops the electrostatic latent image formed on the surface of the photoconductor 1*r* with a toner to form a toner image. The transfer bias roller 21*r* opposes and contacts the photoconductor 1*r* to form a transfer nip between the transfer bias roller 21*r* and the photoconductor 1*r* contacting each other.

The pick-up roller 26 and the feeding roller pair 27 feed a sheet P from the paper tray 31 toward the registration roller pair 28. The registration roller pair 28 feeds the sheet P to the transfer nip at a time when the toner image formed on the surface of the photoconductor 1*r* is properly transferred onto the sheet P. The transfer bias roller 21*r* transfers the toner image formed on the surface of the photoconductor 1*r* onto the sheet P. The transfer bias roller 21*r* is connected to the transfer power source 50*r*. The transfer power source 50*r* applies a transfer bias to the transfer bias roller 21*r*. The transfer power source 50*r* is connected to the controller 51*r* for controlling the transfer bias. The cleaner 2*r* removes a residual toner remaining on the surface of the photoconductor 1*r* even after the toner image formed on the surface of the photoconductor 1*r* is transferred onto the sheet P. The guide 41*r* guides the sheet P bearing the toner image toward the fixing unit 30.

In the fixing unit 30, the sheet P is fed toward a fixing nip formed between the fixing roller 30*a* and the pressing roller 30*b*, which oppose each other. At the fixing nip, the fixing roller 30*a* and the pressing roller 30*b* apply heat and pressure to the sheet P bearing the toner image to fix the toner image on the sheet P.

The guide 41*r* is disposed near and downstream from the transfer nip in the sheet conveyance direction. The guide 41*r* includes the same structure as the guide 41 (depicted in FIGS. 4 and 6). Therefore, even when the sheet P scrubs the guide 41*r* while the sheet P is guided by the guide 41*r* and conveyed toward the fixing unit 30, friction between the sheet P and the guide 41*r* does not decrease an amount of electric charge having the polarity opposite to the polarity of the toner on the sheet P. As a result, scatter of the toner from the sheet P onto the fixing roller 30*a* can be suppressed when the sheet P is conveyed in the fixing unit 30.

As seen in FIGS. 1, 7 and 8, in the image forming apparatuses 100, 100*q*, and 100*r*, the photoconductors 1Y, 1M, 1C, and 1K, the photoconductive belt 1*q*, the photoconductor 1*r*, and the intermediate transfer belts 10 and 10*q* carry a toner image. However, an intermediate transfer drum and/or the like can also be used for carrying a toner image. The intermediate transfer drum may include a metal cylinder. A rubber having a medium resistivity may cover a surface of the metal cylinder.

As seen in FIGS. 1, 7 and 8, in the image forming apparatuses 100, 100*q*, and 100*r*, the first transfer bias rollers 11Y, 1M, 1C, 11K, and 11*q*, the second transfer bias rollers 21 and 21*q*, and the transfer bias roller 21*r* transfer a toner image. However, a transfer belt, a transfer brush, a transfer blade, a transfer plate, and/or the like can also be used for transferring a toner image. For example, the transfer brush may include a rotational transfer brush which rotates and contacts the sheet P to transfer a toner image onto the sheet P.

According to the above-described embodiments, when a sheet P bearing a toner image scrubs the guide 41, 41*q*, or 41*r* while being conveyed from the second transfer nip or the transfer nip to the fixing unit 30, friction between the sheet P and the guide 41, 41*q*, or 41*r* charges the sheet P to have the polarity opposite to the polarity of the toner. Thus, the sheet P can electrostatically carry the toner image effectively. Therefore, the toner is prevented from electrostatically moving from the sheet P to the fixing roller 30*a* easily. Namely, scatter of the toner from the sheet P onto the fixing roller 30*a* can be suppressed.

The guide 41, 41*q*, or 41*r* at least includes a surface portion which directly contacts the sheet P and includes a PET, a PC, or a PVDF. Thus, even in a low temperature and low humidity environment, scatter of the toner from the sheet P onto the fixing roller 30*a* can be suppressed.

The surface portion directly contacting the sheet P includes the guide sheet 43 (depicted in FIG. 4). A portion which does not directly contact the sheet P may include a material which is selected regardless of the polarity with which the sheet P is charged due to friction between the sheet P and the guide 41, 41*q*, or 41*r*. For example, the portion which does not directly contact the sheet P may include a low-cost insulating material such as ABS resins. Thus, the guide 41, 41*q*, or 41*r* can be produced at decreased manufacturing costs. The guide sheet 43 can be attached to the base 41*a* with a double-faced adhesive tape. Thus, the guide sheet 43 can be attached to the base 41*a* at decreased manufacturing costs with enhanced precision.

The surface portion directly contacting the sheet P has a surface resistivity of about $10^9\Omega/\square$ or higher. Even in a high temperature and high humidity environment, the electric charge having the polarity opposite to the polarity of the toner on the sheet P is not transferred from the sheet P to the guide 41, 41*q*, or 41*r*. Thus, when the sheet P is conveyed toward the fixing unit 30, the amount of the electric charge having the polarity opposite to the polarity of the toner on the sheet P does not decrease. As a result, the force of the sheet P for electrostatically attracting the toner does not decrease. Even in the high temperature and high humidity environment, the toner is not electrostatically transferred from the sheet P to the fixing roller 30*a* easily when the sheet P is conveyed in the fixing unit 30. Thus, scatter of the toner from the sheet P onto the fixing roller 30*a* can be suppressed.

The guide 41, 41*q*, or 41*r* includes the discharging teeth 40*a* (depicted in FIGS. 4 and 5) for discharging the sheet P immediately after the second transfer bias roller 21 (depicted in FIG. 1) or 21*q* (depicted in FIG. 7) or the transfer bias roller 21*r* (depicted in FIG. 8) transfers the toner image onto the sheet P, thereby preventing the sheet P from being jammed when the sheet P does not separate from the intermediate transfer belt 10 (depicted in FIG. 1) or 10*q* (depicted in FIG. 7) or the photoconductor 1*r* (depicted in FIG. 8). The electric charge is not abruptly transferred from the backside of the sheet P to a protruding member and/or a metallic member disposed near the second transfer bias roller 21 or 21*q* or the transfer bias roller 21*r* and the fixing unit 30, thereby preventing a defective toner image from being formed on the sheet P. However, the discharging teeth 40*a* remove the electric charge having the polarity opposite to the polarity of the toner from the sheet P, and the sheet P cannot electrostatically attract the toner easily. Therefore, in the low temperature and low humidity environment in which the toner has a decreased amount of the electric charge, the toner is not electrostatically attracted to the sheet P and is electrostatically scattered onto the fixing roller 30*a*. To address this problem, the surface portion of the guide 41, 41*q*, or 41*r*, which is scrubbed by the sheet P while the sheet P is conveyed from the second transfer bias roller 21 or 21*q* or the transfer bias roller 21*r* toward the fixing unit 30, includes a material for charging the sheet P to have the polarity opposite to the polarity of the toner on the sheet P by friction between the sheet P and the surface portion scrubbed by the sheet P. Thus, even when the discharging teeth 40*a* remove the electric charge having the polarity opposite to the polarity of the toner from the sheet P, friction between the sheet P and the surface portion scrubbed by the sheet P can increase the amount of the electric charge having the polarity opposite to the polarity of the toner on the sheet P so as to cause the sheet P to electrostatically attract the toner easily. As a result, the fixing roller 30*a* does not electrostatically scatter the toner from the sheet P. Namely, even when the discharging teeth 40*a* remove the electric charge having the polarity opposite to the polarity of the toner from the sheet P, scatter of the toner from the sheet P onto the fixing roller 30*a* can be suppressed and a proper toner image can be formed on the sheet P.

In the image forming apparatus 100 or 100*q*, plural color toner images are transferred onto a sheet P via the intermediate transfer belt 10 or 10*q* in an indirect transfer method. Namely, plural color toner images formed on the photoconductors 11Y, 1M, 11C, and 11K or the photoconductive belt 1*q* are transferred onto the intermediate transfer belt 10 or 10*q* such that the toner images are superimposed thereon. The superimposed toner images are further transferred onto the sheet P. A larger variety of sheet materials can be used in the indirect transfer method compared to a direct transfer method in which plural color toner images formed on photoconductors are directly transferred onto a sheet such that the toner images are superimposed thereon. In the direct transfer method, a conveying belt opposing the photoconductors electrostatically attracts the sheet. The conveying belt conveys the sheet so that the toner images formed on the photoconductors are transferred onto the sheet at transfer nips formed between the photoconductors and the conveying belt. The conveying belt may not stably attract thick paper which is not easily charged. The thick paper may slip on the conveying belt and may not be conveyed to the transfer nips at predetermined times when the toner images formed on the photoconductors are properly transferred onto the thick paper such that the toner images are superimposed thereon. For example, the thick paper may be conveyed to the transfer nips at delayed times. As a result, the toner images are misaligned when the toner images are transferred on the thick paper. To form a high quality image on a sheet, the thick paper cannot be used in an image forming apparatus using the direct transfer method. In the image forming apparatus 100 (depicted in FIG. 1) or 100*q* (depicted in FIG. 7) using the indirect transfer method, toner images are transferred onto a sheet P at the second transfer nip. Even when the sheet P is conveyed to the second transfer nip at a slightly delayed time, the toner images, which form the color toner image, may not be transferred onto the sheet P, thereby preventing formation of misaligned color toner images. In the indirect transfer method, the toner images are not misaligned when the toner images are transferred on thick paper. Thus, the indirect transfer method can use a larger variety of sheet materials compared to the direct transfer method.

The intermediate transfer belt 10 (depicted in FIG. 1) or 10*q* (depicted in FIG. 7) may be formed of a single layer which can be prepared at an increased manufacturing yield. Thus, the intermediate transfer belt 10 or 10*q* can be manufactured at low costs. In addition, the volume resistivity of the intermediate transfer belt 10 or 10*q* can be easily managed, thereby reducing variations of the transferor in the transfer property.

The intermediate transfer belt 10 or 10*q* may also be formed of a plurality of layers having a plurality of functions. For example, when the intermediate transfer belt 10 or 10*q* includes an outermost layer including a material having high releasing property and resistivity, the intermediate transfer belt 10 or 10*q* can provide an improved transfer property and thereby the toner scattering problem is not caused.

The image forming apparatuses 100, 100*q*, and 100*r* (depicted in FIGS. 1, 7 and 8, respectively) use a polymerized toner produced by a polymerization method. The polymerized toner has a shape factor SF-1 in a range of from about 100 to about 180 and a shape factor SF-2 in a range of from about 100 to about 180. As described above, a polymerized toner can provide increased transfer efficiency. However, toner particles of the polymerized toner do not tightly adhere to each other or to a sheet P. Thus, the toner easily scatters from the sheet P onto the fixing roller 30*a*. To address this problem, the surface portion of the guide 41, 41*q*, or 41*r*, which is scrubbed by the sheet P conveyed toward the fixing unit 30, includes a material for charging the sheet P to have the polarity opposite to the polarity of the toner by friction between the sheet P and the surface portion scrubbed by the sheet P. Thus, the sheet P can electrostatically attract the toner easily while being conveyed toward the fixing unit 30. Even such a polymerized toner including toner particles which are not tightly adhered to the sheet P can suppress scatter of the toner from the sheet P onto the fixing roller 30*a* due to an electrostatic force of the fixing roller 30*a*. As a result, the image forming apparatuses 100, 100*q*, and 100*r* can form a high quality image even with the polymerized toner.

According to the above-described embodiments, when a sheet P bearing a toner image scrubs the guide 41, 41*q*, or 41*r* (depicted in FIGS. 1, 7 and 8, respectively) while being conveyed from the second transfer nip or the transfer nip to the fixing unit 30, friction between the sheet P and the guide 41, 41*q*, or 41*r* charges the sheet P to have the polarity opposite to the polarity of the toner. Thus, the sheet P can electrostatically carry the toner image with an increased force. Therefore, the toner does not electrostatically move from the sheet P to the fixing roller 30*a* easily even in a low temperature and low humidity environment. Namely, scatter of the toner from the sheet P onto the fixing roller 30*a* can be suppressed. A high voltage power source for applying a bias to the fixing roller 30*a* is not needed, resulting in decreased manufacturing costs. In addition, the sheet P has an increased force for electrostatically carrying the toner image while being conveyed from the second transfer nip or the transfer nip to the fixing unit 30. Therefore, even when the image forming apparatus 100, 100*q*, or 100*r* uses a toner including toner particles not tightly adhered to each other or to the sheet P, the toner does not electrostatically move from the sheet P to the fixing roller 30*a* easily and thereby scatter of the toner from the sheet P onto the fixing roller 30*a* can be suppressed. Even when the discharging teeth 40*a* remove the electric charge having the polarity opposite to the polarity of the toner from the sheet P, friction between the sheet P and the guide 41, 41*q*, or 41*r* scrubbed by the sheet P increases the amount of the electric charge having the polarity opposite to the polarity of the toner on the sheet P while the sheet P is conveyed toward the fixing unit 30. As a result, the sheet P can have an increased force for electrostatically carrying the toner image while the sheet P is conveyed from the second transfer nip or the transfer nip to the fixing unit 30. Thus, scatter of the toner from the sheet P onto the fixing roller 30*a* can be suppressed.

The present invention has been described above with reference to specific exemplary embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative exemplary embodiments may be combined with each other and/or substituted for each other within the scope of the present invention.

What is claimed is:

1. An image forming apparatus, comprising:

an image carrier configured to carry a toner image;

a transferor opposing the image carrier to form a transfer nip and configured to transfer the toner image on the image carrier onto a recording medium at the transfer nip;

a fixing unit configured to fix the toner image on the recording medium; and a guide configured to guide the recording medium bearing the toner image from the transferor toward the fixing unit and including a surface portion directly contacting the recording medium, the surface portion including a material configured to charge the recording medium to have a polarity opposite to the polarity of a toner forming the toner image by friction between the surface portion and the recording medium, the guide including a plurality of insulating ribs extending from a base of the guide and arrayed in a direction that is transverse with respect to a conveying direction of the recording medium, and a discharger disposed on a portion of the base of the guide from which the ribs extend and configured to discharge the recording medium immediately after the transferor transfers the toner image onto the recording medium, the discharger including a plurality of discharging teeth that each extend in a direction substantially parallel to the conveying direction of the recording medium, the discharger and the plurality of insulating ribs being positioned such that each of the ribs of the plurality of insulating ribs is disposed between two adjacent discharging teeth of the plurality of discharging teeth.

2. The image forming apparatus according to claim 1, wherein the image carrier includes an intermediate transfer member configured to carry different plural color toner images.

3. The image forming apparatus according to claim 2, wherein the intermediate transfer member has an endless belt-like shape and is formed of one or more layers.

4. The image forming apparatus according to claim 3, wherein the intermediate transfer member has an endless belt-like shape with at least one layer including one or more of polyvinylidene fluoride, ethylene-tetrafluoroethylene copolymers, polyimide, and polycarbonate.

5. The image forming apparatus according to claim 3, wherein the intermediate transfer member has an endless belt-like shape with at least one layer including a conductive material configured to control the volume resistivity of the intermediate transfer member in a range of from about $10^8\Omega\cdot$cm to about $10^{12}\Omega\cdot$cm.

6. The image forming apparatus according to claim 3, wherein the intermediate transfer member has an endless belt-like shape with at least one layer including a conductive material configured to control the surface resistivity of the intermediate transfer member in a range of from about $10^8\Omega/\square$ to about $10^{15}\Omega/\square$.

7. The image forming apparatus according to claim 1, wherein the surface portion of the guide includes at least one of polyethylene terephthalate, polycarbonate, and polyvinylidene fluoride.

8. The image forming apparatus according to claim 1, wherein the surface portion includes a sheet member.

9. The image forming apparatus according to claim 8, wherein the sheet member is attached to the base of the guide with a double-faced adhesive tape.

10. The image forming apparatus according to claim 1, wherein the surface portion of the guide has a surface resistivity not lower than about $10^9\Omega/\square$.

11. The image forming apparatus according to claim 1, wherein the toner of the toner image includes a polymerized toner produced by a polymerization method.

12. The image forming apparatus according to claim 1, wherein the toner of the toner image has a shape factor SF-1 in a range of from about 100 to about 180 and a shape factor SF-2 in a range of from about 100 to about 180.

13. A guide for guiding a recording medium bearing a toner image from a transferor toward a fixing unit, comprising:

a discharger disposed on a portion of a base of the guide and configured to discharge the recording medium immediately after the transferor transfers the toner image onto the recording medium, the discharger including a plurality of discharging teeth that each extend in a direction substantially parallel to a conveying direction of the recording medium;

a surface portion directly contacting the recording medium and including a material configured to charge the recording medium to have a polarity opposite to the polarity of a toner forming the toner image by friction between the surface portion and the recording medium; and a plurality of insulating ribs extending from the portion of the base of the guide on which the discharger is disposed and arrayed in a direction that is transverse with respect to the conveying direction of the recording medium, the discharger and the plurality of insulating ribs being positioned such that each of the ribs of the plurality of insulating ribs is disposed between two adjacent discharging teeth of the plurality of discharging teeth.

14. The guide according to claim 13, wherein the surface portion includes at least one of polyethylene terephthalate, polycarbonate, and polyvinylidene fluoride.

15. The guide according to claim 13, wherein the surface portion includes a sheet member.

16. The guide according to claim 15, further comprising a base to which the sheet member is attached with a double-faced adhesive tape.

17. The guide according to claim 13, wherein the surface portion of the guide has a surface resistivity not lower than about $10^9\Omega/\square$.

18. An image forming apparatus, comprising:

an image carrier configured to carry a toner image;

a transferor opposing the image carrier to form a transfer nip and configured to transfer the toner image on the image carrier onto a recording medium at the transfer nip;

a fixing unit configured to fix the toner image on the recording medium; and a guide configured to guide the recording medium bearing the toner image from the transferor toward the fixing unit and including a surface portion directly contacting the recording medium, the surface portion including a material configured to charge the recording medium to have a polarity opposite to the polarity of a toner forming the toner image by friction between the surface portion and the recording medium, the guide including a plurality of insulating ribs arrayed in a direction that is transverse with respect to a conveying direction of the recording medium, wherein the guide further includes a discharger configured to discharge the recording medium immediately after the transferor transfers the toner image onto the recording medium, and wherein the discharger includes a plurality of discharging teeth that each extend in a direction substantially parallel to the conveying direction of the recording medium, and the discharger and the plurality of insulating ribs are positioned such that each of the ribs of the plurality of insulating ribs is disposed between two adjacent discharging teeth of the plurality of discharging teeth.

* * * * *